US012037161B2

(12) United States Patent
Ritzberger et al.

(10) Patent No.: US 12,037,161 B2
(45) Date of Patent: Jul. 16, 2024

(54) PLASTIC PALLET WITH SNAP CONNECTION

(71) Applicant: GEORG UTZ HOLDING AG, Bremgarten (CH)

(72) Inventors: Axel Ritzberger, Altendorf (CH); Rüdiger Sostmann, Lingen (DE)

(73) Assignee: GEORG UTZ HOLDING AG, Bremgarten (CH)

( * ) Notice: Subject to any disclaimer, the term of this patent is extended or adjusted under 35 U.S.C. 154(b) by 127 days.

(21) Appl. No.: 17/997,408

(22) PCT Filed: Apr. 29, 2021

(86) PCT No.: PCT/IB2021/053569
§ 371 (c)(1),
(2) Date: Oct. 28, 2022

(87) PCT Pub. No.: WO2021/224732
PCT Pub. Date: Nov. 11, 2021

(65) Prior Publication Data

US 2023/0166885 A1 Jun. 1, 2023

(30) Foreign Application Priority Data

May 7, 2020 (CH) ..... 00549/20

(51) Int. Cl.
*B65D 19/00* (2006.01)

(52) U.S. Cl.
CPC ..... *B65D 19/0069* (2013.01); *B65D 2519/00034* (2013.01); *B65D 2519/00069* (2013.01);
(Continued)

(58) Field of Classification Search
CPC ..... B65D 2519/00567
See application file for complete search history.

(56) References Cited

U.S. PATENT DOCUMENTS 5,483,899 A 1/1996 Christie
5,794,543 A * 8/1998 John ..... B65D 19/0022 108/56.1
5,934,486 A * 8/1999 Jarvis ..... A47L 19/04 220/4.03
8,739,706 B2 6/2014 Dubois et al.
(Continued)

FOREIGN PATENT DOCUMENTS

CH 685549 A5 8/1995
CH 702628 A2 8/2011
(Continued)

OTHER PUBLICATIONS

International Search Report mailed on Jul. 27, 2021, in connection with corresponding International Application No. PCT/IB2021/053569 (6 pp., including machine-generated English translation).

*Primary Examiner* — Daniel J Rohrhoff
(74) *Attorney, Agent, or Firm* — McCormick, Paulding & Huber, PLLC

(57) ABSTRACT

The invention relates to a plastic pallet (1) with an upper part (2) provided with female foot parts (4, 4') and skids (3, 3') provided with male foot parts (5, 5'). The male foot parts (5, 5'), together with the female foot parts (4, 4'), form feet (21, 21'), with the foot parts (4, 4') of the upper part and the foot parts (5, 5') of the skids (3 3') being fastened to one another by means of snap connections (6). Each male foot part (5, 5') includes at least two snap hooks (8), which are arranged with mirror symmetry in pairs and which each have a hook head (9) with undercut (91), a snap arm (8') and a rear side (10), the undercuts (9') of the hook heads (9) facing away from one another and the rear sides (10) of the snap hooks (8) facing towards one another. Each female foot part (4, 4') includes at least one latch element (7), into which the hook heads (9) are engaged, forming a snap connection (6) in each
(Continued)

case. The female foot parts (4, 4') are integrally connected to the upper part (2). Each female foot part (4, 4') includes at least one securing element (12), each with at least one free end (13), the securing element (12) being integrally connected to the female foot part (4, 4'), and the securing element (12) protruding into an intermediate space (24) between the rear sides (10) of the snap hooks (8) so that the snap hooks (8) remain in the engaged position.

20 Claims, 9 Drawing Sheets

(52) U.S. Cl.
CPC ..... *B65D 2519/00323* (2013.01); *B65D 2519/00338* (2013.01); *B65D 2519/00407* (2013.01); *B65D 2519/00412* (2013.01); *B65D 2519/00567* (2013.01)

(56) References Cited

U.S. PATENT DOCUMENTS

| | | | | |
|---|---|---|---|---|
| 8,950,342 | B2 * | 2/2015 | Plattner | B65D 19/0016 108/57.25 |
| 11,066,210 | B1 * | 7/2021 | Ankele | B65D 19/42 |
| 11,584,563 | B2 * | 2/2023 | Sostmann | B65D 19/0026 |
| 2007/0234933 | A1 * | 10/2007 | Donnell | B65D 19/0016 108/56.3 |
| 2020/0216219 | A1 * | 7/2020 | Shawaf | B29C 65/58 |

FOREIGN PATENT DOCUMENTS

| | | | |
|---|---|---|---|
| EP | 2733084 | B1 | 12/2016 |
| GB | 2272203 | A | 5/1994 |
| GB | 2421939 | A | 7/2006 |
| JP | H04-267735 | A | 9/1992 |
| WO | 2005/118412 | A1 | 12/2005 |

* cited by examiner

PLASTIC PALLET WITH SNAP CONNECTION

CROSS-REFERENCE TO RELATED APPLICATION

This application is a National Stage application of International Patent Application No. PCT/IB2021/053569, filed Apr. 29, 2021, which claims the priority of Swiss patent application 00549/20, filed May 7, 2020, the disclosure of each of which is incorporated herein by reference in its entirety.

TECHNICAL FIELD

The invention relates to a plastic pallet with an upper part and three or more skids.

BACKGROUND OF THE INVENTION

Pallets are used for storage and transportation of goods. The pallets keep the goods off the ground so that they can be lifted and transported by a forklift truck. They usually consist of a flat upper part and, in the case of pallets in the size of 1200×800 mm, three skids, which can be produced in one piece by injection molding or in multiple pieces. Multi-part plastic pallets are easier and cheaper to produce and consist, for example, of an upper part and a lower part which are connected in an interlocking manner. The lower part usually has three skids and nine feet.

The upper part and the lower part, or the skids, can be connected by welding, as described in CH702628 or CH685549. When the upper part is welded to the lower part, a bead is formed which must be removed by a milling operation so that the pallet has a smooth surface. This is time consuming and expensive.

Furthermore, the multiple parts can be connected to one another via snap locks. GB2421939 discloses a plastic pallet having a planar upper part and a planar lower part as well as nine separate feet via which the upper and lower parts are connected to each other, both ends of the feet being attached in each case to the upper and lower parts of the pallet by means of snap locks.

U.S. Pat. No. 5,483,899 discloses a pallet having a lower part and an upper part which can be pushed into one another, the lower part of the pallet having ribs with a snap element arranged at the upper end of each rib. By means of this snap element at the upper end of the ribs of the lower part of the pallet, the snap connection with the upper part is obtained.

From EP2733084, a plastic pallet is known with an upper part and a lower part, wherein the feet of the upper part and the lower part can be pushed completely into each other and locked by means of snap connections. In this case, the outer region of the feet is formed by the skids.

U.S. Pat. No. 5,794,543 A describes a modular pallet system with individual lower bottom elements and an upper element with a primary surface. In addition, the system includes complementary engagement elements of the upper and lower elements that interlock and connect the upper and lower elements together.

The known multi-part plastic pallets have the disadvantage that the connection between the different parts can disengage under continuous load and the upper part separates from the feet or skids, respectively.

SUMMARY

It is now the object of the present invention to provide a multi-part plastic pallet which permits a connection between the upper part and the skids, wherein this connection is able to better withstand the load caused by an impact of the pallets during transport and, if possible, does not open even under high load.

This object is achieved by a plastic pallet with an upper part and skids, the upper part being provided with outer and middle female foot parts and the skids being provided with outer and middle male foot parts, wherein the male foot parts of the skids can be pushed into the female foot parts of the upper part, and wherein in the assembled state of the plastic pallet, the male foot parts together with the female foot parts form feet. The foot parts of the upper part and the foot parts of the skids can be fastened to one another by means of snap connections. Each male foot part comprises at least two snap hooks which are arranged with mirror symmetry in pairs and which each have a hook head with undercut, a snap arm and a rear side, the undercuts of the hook heads facing away from one another and the rear sides of the snap hooks facing one another. Each female foot part comprises at least one latch element into which the hook heads are engaged in the assembled state, thereby forming a snap connection in each case. The female foot parts are integrally connected to the upper part. An intermediate space is arranged between the rear sides of the snap hooks. Each female foot part comprises at least one securing element, each having a free end, the securing element being integrally connected to the female foot part, and the securing element protruding into the intermediate space between the rear sides of the snap hooks so that the snap hooks remain in the engaged position.

The arrangement of the at least one securing element between the snap hooks arranged in pairs allows the snap hooks to be retained in the engaged position when the plastic pallet is in the assembled state, and to not disengage from the engaged position without additional tools. The securing element results in a secure connection between the upper part and the foot parts of the skids, thus securing the attachment of skids to the upper part.

Preferably, the respective free end of the at least one securing element is tapered towards its center. The free end can be rounded or pointed towards the center. The shape of the free end of the securing element, which tapers towards the center, is particularly suitable for making it easier for the snap hooks to slide into the desired engaged position when assembling the skids along the securing element.

Preferably, the free end of the at least one securing element is symmetrically pointed. Preferably, the free end of the at least one securing element has an arrow-shaped cross-section. The symmetrically pointed end is of advantage so that each snap hook is guided along a beveled surface of the free end of the securing element when assembling the pallet. A securing element can also have a plurality of free ends, preferably arranged side by side, which are preferably tapered towards the center, more preferably symmetrically pointed.

In a preferred embodiment, the snap hook with hook head and undercut is designed to be wide in order to increase the snap connection area between the hook head and the latch element and to strengthen the snap connection. Preferably, the at least one securing element between a pair of snap hooks has two free ends which are tapered towards the center, preferably symmetrically pointed.

Each snap hook comprises a snap arm, a rear side and a hook head with undercut. The hook head has a substantially straight rear side and a front side with an undercut. In a particularly preferred embodiment, the last portion of the rear side of the snap hook in the region of the hook head leading to the tip is beveled or rounded, preferably beveled.

This results in the fact that the tip of the hook head is weakened at the end of the snap hook and does not abut against the free end of the securing element when assembling the skids to the upper part. Thus, when assembling the skids to the upper part, the rear side of the hook head slides continuously along the free end of the securing element into the engaged state. As such, the snap hook has resilient properties.

The latch element has at least one recess in which the hook head of the snap hook can engage. The latch element can also have two recesses in which in each case one hook head of a pair of snap hooks is engaged. In a preferred embodiment, the latch element has an elongated shape in cross-section, with each of the recesses being arranged on the longitudinal sides of the latch element parallel to the width of the hook head. Each hook head of the snap hook engages in a recess of the latch element, and the undercut of the hook head together with the latch element forms a snap connection.

A snap connection is a positive connection and is formed by a hook head with undercut and a latch element with recess, which are designed as mating parts. The hook head engages in the recess of the latch element and the region of the undercut of the hook head engages in the latch element. Such a snap connection has the advantage that the connection is pressed together other under load, which further strengthens the connection. In addition, this snap connection has a resilient property under load.

Depending on the desired strength of the connection between the two parts of the pallet, the feet can have multiple snap connections. In one embodiment of the invention, each foot has one or more snap connection pairs, preferably one or two pairs. In one embodiment, the feet can also have four pairs of snap connections and thus eight snap connections, preferably at the outer feet of the middle skid. Due to the multiple snap connections, the strength of the feet is further increased and secured.

In one embodiment, the female foot parts of the upper part have an outer wall with ribs and the male foot parts of the skids have an inner wall with ribs. Preferably, the outer wall of the female foot parts encloses the male foot parts. The outer wall of the outer female foot part extends substantially over the entire height of the outer male foot part such that the outer male foot parts of the skids can be completely pushed into the outer female foot parts of the upper part.

The outer wall of the female foot parts encloses the male foot parts such that the male outer foot parts are fully protected in the event of an impact. The outer wall extends over the entire height of the outer female foot part, preferably substantially around the entire foot. By entire height it is understood that the outer wall of the outer female foot part extends from the upper side of the pallet to the lower side of the skid which can be placed on a support surface. Preferably, the outer wall extends around the entire foot except for a recess for a connecting piece of the skids which connects the outer male foot parts to the middle male foot part. Thus, in the assembled state of the pallet, the outer wall extends on at least three sides of the outer female foot parts from the upper side of the pallet to the lower side of the skids.

The ribs of the female foot parts and the ribs of the male foot parts preferably extend over substantially the entire height of each foot part. The ribs can have different cross-sections and can be, for example, T-shaped, angled, or rectangular in cross-section. The ribs of the female foot parts and the ribs of the male foot parts can be completely pushed into each other.

Preferably, the male foot parts of the skids have an inner wall with ribs which serve as spacers between the inner wall and the outer wall. On the one hand, these ribs also serve as a guide when assembling the skids to the upper part of the pallet and on the other hand, they form a gap between the inner wall and the outer wall, which serves as additional impact protection. In the event of an impact of the plastic pallet against an object, the ribs can bend slightly and the gap between the inner and outer walls can be reduced for a short time, which absorbs the impact.

Preferably, the plastic pallet has three skids, each having two outer male foot parts and a middle male foot part. Preferably, the plastic pallet according to the invention has three longitudinal skids. This is the case, for example, with plastic pallets of the standard size of 1200×800 mm. In this case, the outer male foot parts are inserted into the outer female foot parts and form outer feet which are provided on the short transverse side of the plastic pallet. The middle female and male foot parts, which form the middle feet, are preferably provided in the middle of the pallet transverse to the longitudinal side.

In another embodiment, the plastic pallet has more than three skids, for example five or six skids. For example, five or six skids are preferred for pallets of size 1200×1000 mm. For example, a pallet of this type is possible with five skids, of which three skids extend in one direction and two skids extend in the transverse direction along the sides of the pallet. In another embodiment, the pallet includes six skids, three longitudinal skids and three transverse skids. In this embodiment, preferably all of the outer eight feet have outer walls which extend at least on the outside of the feet, i. e., on the side which is arranged at the border of the plastic pallet, over the entire height of the outer female foot parts.

Preferably, the upper part of the plastic pallet has a flat upper side. In a preferred embodiment, the upper side has a continuous closed surface. Preferably, the lower side of the upper part has cross struts to reinforce the upper part. In another embodiment, the upper part comprises reinforcing tubes that additionally reinforce the upper part of the plastic pallet.

In a preferred embodiment, the male foot parts of a single skid can be pushed separately from the male foot parts of the other skids into the foot parts of the upper part. Thus, the three skids can be inserted individually into the upper part and the plastic pallet can be produced from four pieces. However, it is also possible that the three skids are connected to each other and consist of one piece, so that the plastic pallet can be assembled from two pieces, the upper part and a lower part provided with skids.

The foot parts of the upper part and the foot parts of the skids are preferably integrally connected to the upper part and the skid, respectively. This design, together with the snap connection, makes it possible to assemble a pallet from only two or four parts, respectively, and without the use of tools.

When joining the upper part to the skids, the male foot parts with the inner wall and the ribs are preferably pushed completely into the female foot parts with the outer wall and the ribs, so that their ribs are pushed completely into each other and are arranged parallel to each other over their entire length thereby forming the feet of the pallet, and the inner walls of the male foot part and the outer walls of the female foot part form double walls of the feet. The double walls provide increased strength to the feet such that they are more robust, withstand impacts from a forklift truck or other objects, and thus can be used for longer periods of time.

The construction of the feet allows for easy and quick assembly of the two parts of the pallet, and the snap connection allows for efficient locking without the need for a tool. If desired, the snap connection can still be opened again by using a screwdriver per snap hook to reach between the snap hook and the latch element from the lower side of the skid and push the snap hook out of the latch element. However, this is not possible without additional tools.

The arrangement of the pallet according to the invention results in the male foot parts of the skids being protected by the female foot parts of the upper part. During transport, for example on conveyor belts or during transport by forklift trucks, the short transverse sides of the pallet with longitudinal skids frequently collide with objects and must be robust against impacts. The outer feet in particular are exposed to strong forces. The male foot parts of the skids are protected by the outer wall of the outer female foot parts which extends over the entire height of the outer male foot parts. In the case of an impact of the outer feet against objects, shear forces are generated which are amplified by the weight of the transported goods on the upper side of the pallet. In the pallet according to the invention, these forces are directed into the ground via the upper side of the pallet and the female foot parts. In this case, the feet of the upper part are loaded and not the feet of the skids. As a result, the snap connection withstands even strong impacts and does not disengage even under continuous load.

The combination of a snap connection according to the invention, which remains in the engaged position due to the securing element, and the outer and inner walls of the foot parts with ribs, which serve as impact protection, leads to an extremely stable connection between the skids and the upper part and thus to increased impact resistance and longer service life compared with conventional plastic pallets.

Further advantages of the invention arise from the following description in which the invention is explained in more detail with reference to exemplary embodiments illustrated in the drawings.

BRIEF DESCRIPTION OF THE DRAWINGS

In the figures.

In each of the figures, the same reference signs are used for the same elements, and explanations of a particular reference sign apply to all of the figures unless expressly stated otherwise.

DESCRIPTION OF THE PREFERRED EMBODIMENTS

Figure 1A:
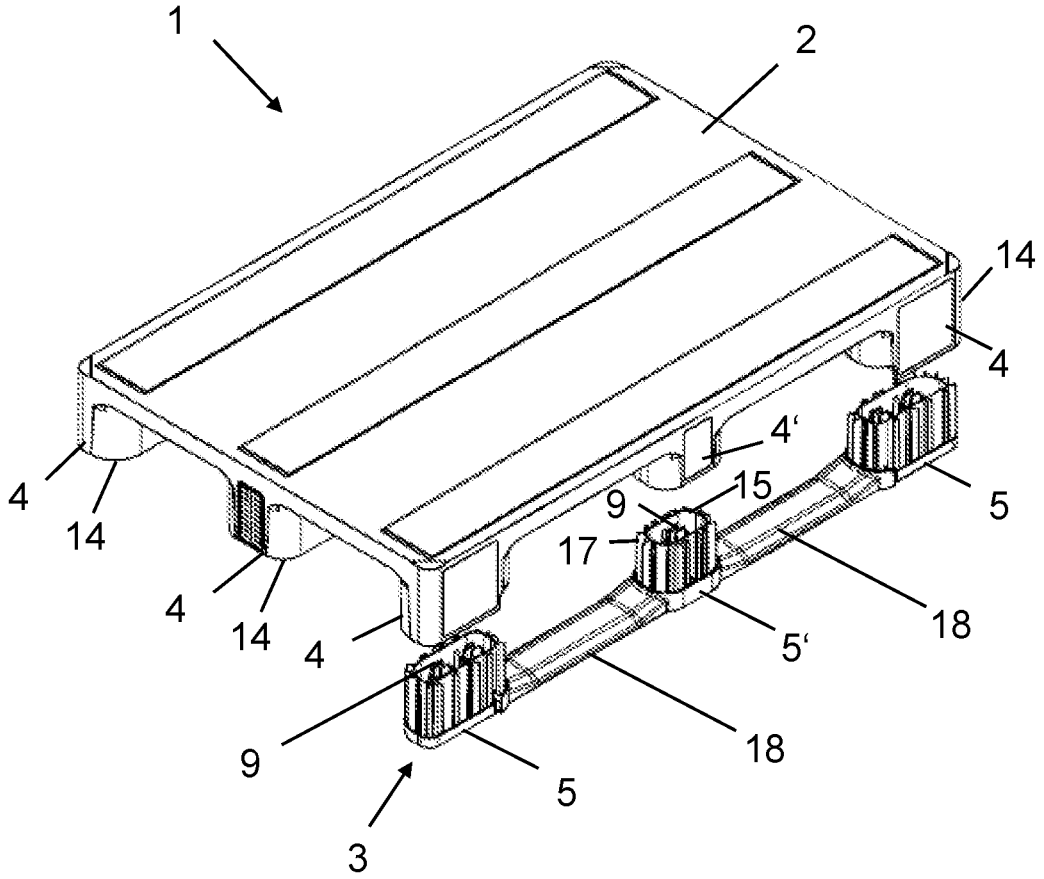
FIG. 1A shows a plastic pallet with upper part and three skids in perspective view obliquely from above with separate view of the upper part and skid.

FIG. 1A shows the upper part 2 and an outer skid 3 of the plastic pallet 1 according to the invention. The skid 3 is shown in the separated and unassembled state. The upper part 2 has outer female foot parts 4, four are shown here, and middle female foot parts 4', one of which is visible here. Skid 3 is provided with two outer male foot parts 5 and one middle male foot part 5'. The male foot parts 5, 5' have snap hooks with hook heads 9. The outer male foot parts 5 of the outer skid 3 have two pairs of snap hooks with four hook heads 9, and the middle male foot part 5' of the outer skid 3 has one pair of snap hooks with two hook heads. The male foot parts 5, 5' have an inner wall 15 with ribs 17 which serve as spacers between the inner wall 15 and the outer wall 14 of the female foot parts 4, 4' and as guides when assembling the skids to the upper part of the pallet. The male foot parts 5, 5' are connected to each other by connecting pieces 18 and form the skids 3.

Figure 1B:
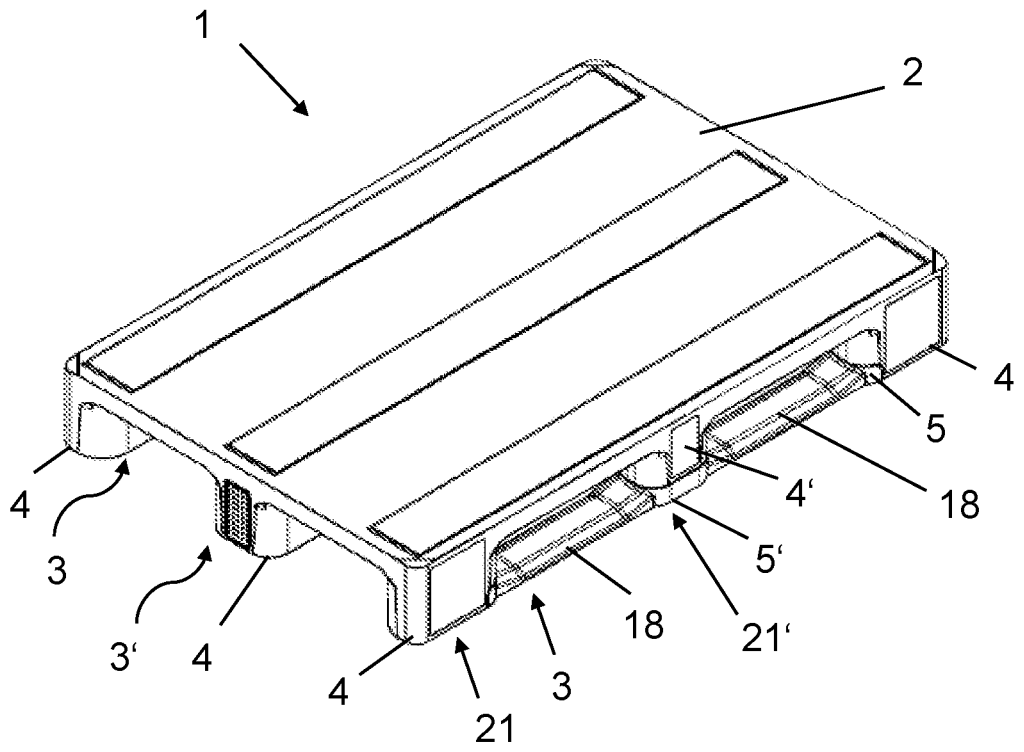
FIG. 1B shows a perspective view of a plastic pallet according to the invention in the assembled state in a view obliquely from above of the upper side of the pallet.

FIG. 1B shows the plastic pallet 1 according to the invention in the mounted, assembled state, in which the three skids 3, 3' (here only the connecting pieces 18 of one skid 3 are visible) are inserted into the upper part 2. In this case, the skids 3, 3' are inserted into the female foot parts 4, 4' via the male foot parts 5, 5' (shown in FIG. 4A) so that the male foot parts 5, 5' assembled to the female feet 4, 4' form feet 21, 21' (shown in FIG. 4A), and so that the female foot parts 4, 4' of the upper part and the male foot parts 5, 5' of the skids can be fastened to one another by means of a snap connection 6 (not visible). The snap connection is formed by the snap hook (8, not visible, shown in FIG. 4A) and the latch element (7, not visible, shown in FIG. 4A). The plastic pallet 1 has six outer female foot parts 4 and six outer male foot parts 5 which are arranged along the two short transverse sides of the pallet and which together form the six outer feet 21 (shown in FIGS. 2A, 2B and 4A).

Figure 2A:
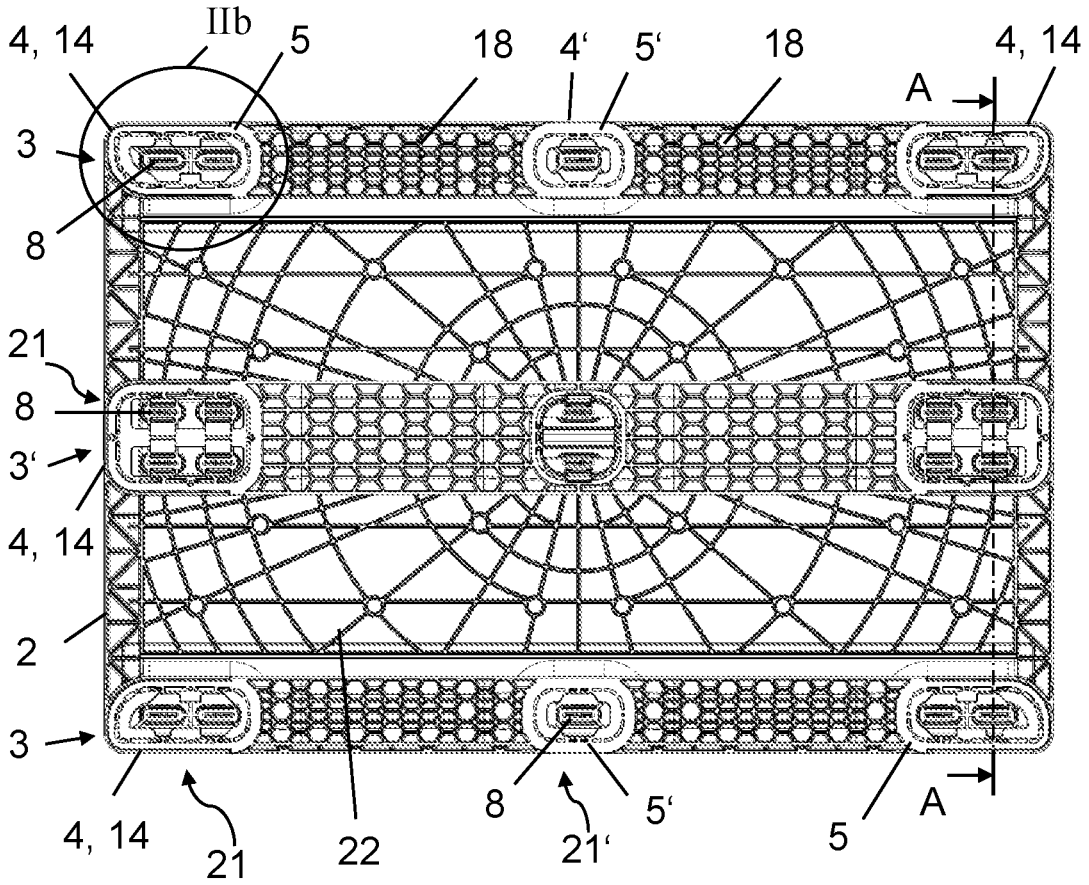
FIG. 2A shows a plastic pallet in a view from below of the lower side of the pallet.

FIG. 2A shows the lower side of the assembled plastic pallet 1 with a view of the lower side of the two outer skids 3 and the middle skid 3', and of the lower side of the upper part 2 with the cross struts 22. The two outer skids 3 each have two outer male foot parts 5 and one middle male foot part 5' and, together with the in each case two outer female foot parts 4 and one middle female foot part 4', form in each case two outer feet 21 and one middle foot 21. The middle skid 3' has two outer male foot parts 5 and one middle male foot part 5' and, together with the two outer female foot parts 4 and the middle female foot part 4', forms two outer feet 21 and one middle foot 21'. Also shown is the lower side of the snap hooks 8 and the connecting pieces 18 of the skids 3, 3'. The lower side of the outer wall 14 of the outer female foot part together with the lower side of the male foot part 5, 5' and the skids 3, 3' form a support surface. Furthermore, the cross struts 22 of the upper part 2 are visible, which serve as reinforcement of the upper part to increase the load-bearing capacity of the pallet.

Figure 2B:
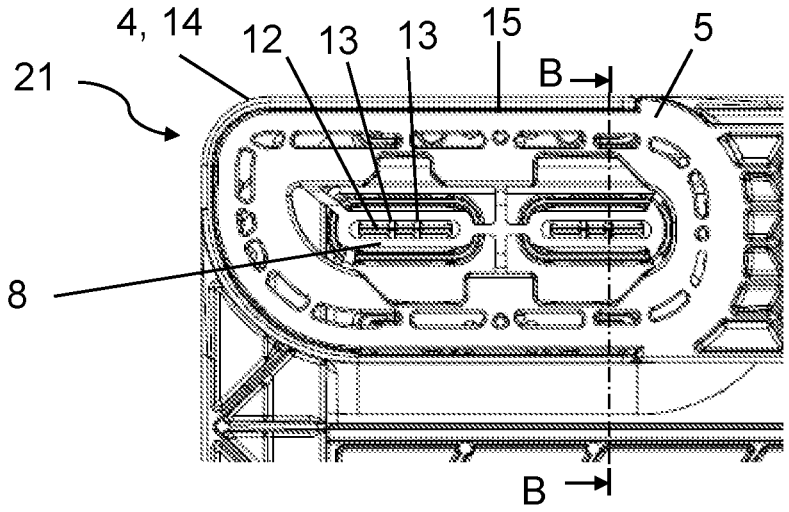
FIG. 2B shows a detailed view from below of the lower side of a foot according to section IIb of FIG. 2A.

FIG. 2B shows the detail IIb from FIG. 2A and the lower side of a foot 21 in enlargement. The lower side of the outer wall 14 of the outer female foot part 4 is shown, which, together with the lower side of the outer male foot part 5 and the connecting piece 18 of the skid 3, forms a support surface. Also shown are the inner wall 15 of the male foot part 5 and the view from below of the snap hooks 8 and the securing elements 12 with their two free ends 13. Between a pair of snap hooks 8 there are two free ends 13 of the securing element 12.

Figure 3:
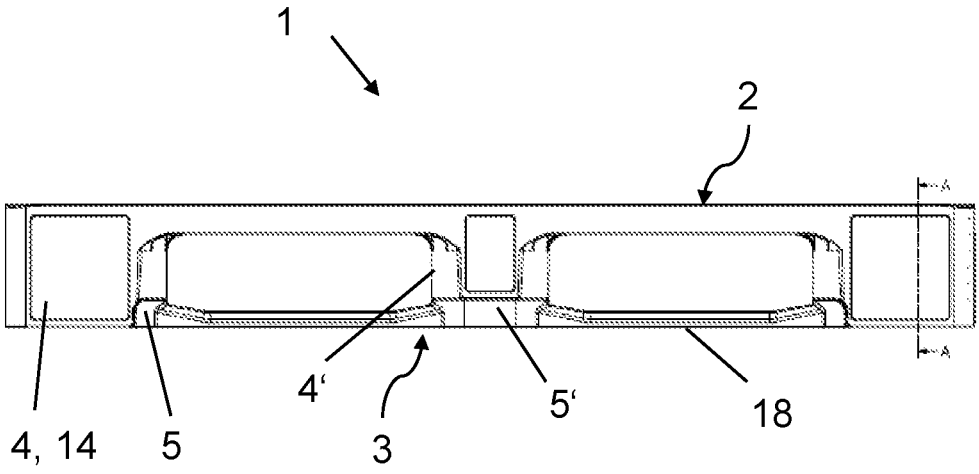
FIG. 3 shows a side view of a plastic pallet according to the invention in the assembled state of the longitudinal side of the pallet.

FIG. 3 shows a side view of a longitudinal side of the plastic pallet 1 with the upper part 2 and the skids 3. Two outer female foot parts 4, of which the outer wall 14 is visible, a middle female foot part 4' as well as two outer male foot parts 5 and a middle male foot part 5' are shown. The male foot parts are connected to each other by a connecting piece 18.

Figure 4A:
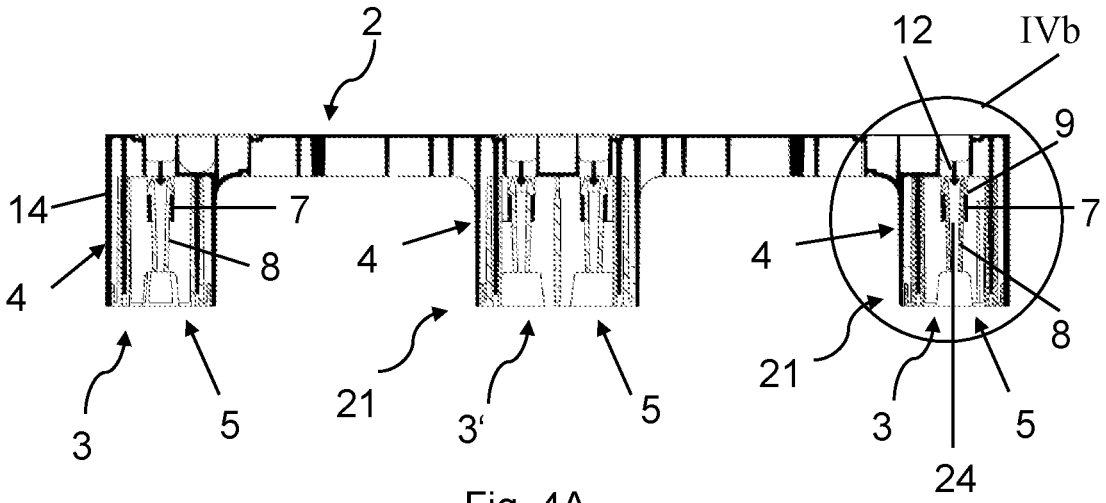
FIG. 4A shows a cross-section through the axis along the line A-A of FIGS. 2A and 3, respectively.

FIG. 4A shows a cross-section through the axis along line A-A of FIG. 2A and FIG. 3 through the snap connections of the outer female foot parts 4 and the outer male foot parts 5, which together form feet 21. In particular, snap hooks 8 with hook head 9 and the associated latch elements 7 are shown, which engage with each other when the upper part 2 is assembled to the skids and lock the upper part 2 with the skids 3, 3'. Also shown are the securing elements 12.

Figure 4B:
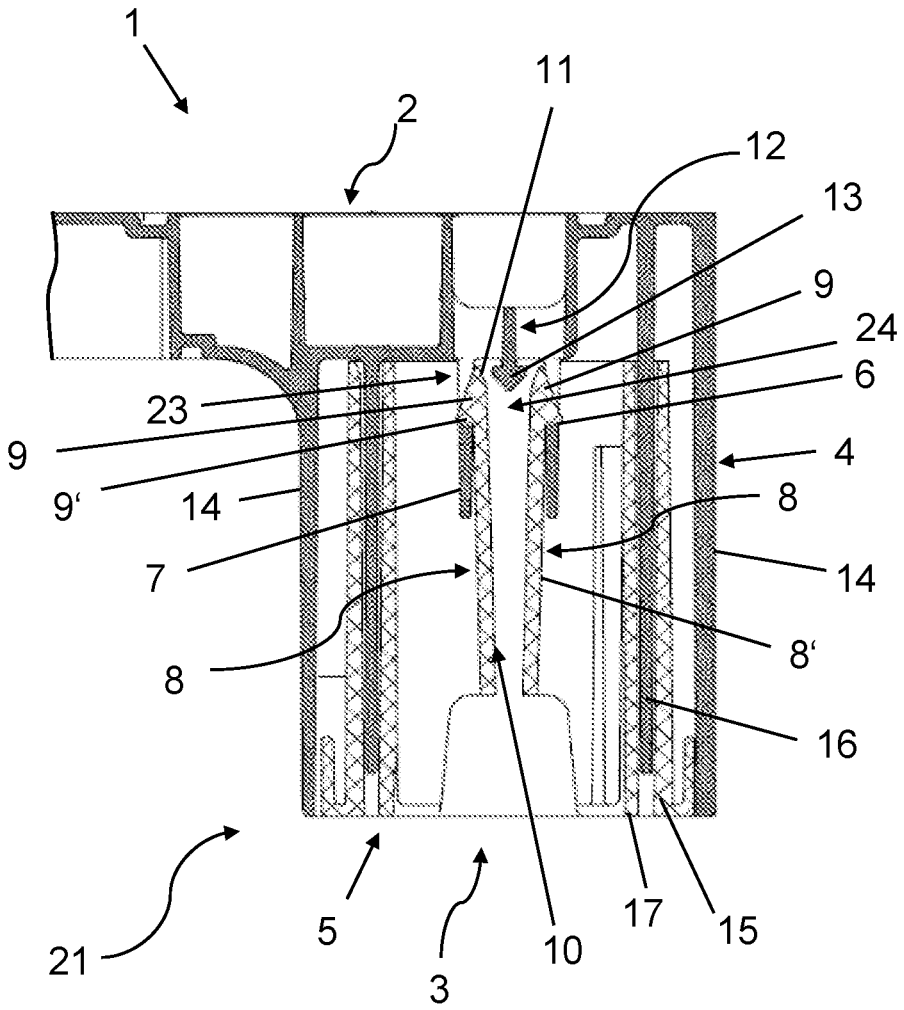
FIG. 4B shows a detailed view of the cross-section of the foot IVb of FIG. 4A along the line B-B of FIG. 2B.

FIG. 4B shows the detail IVb of FIG. 4A and a detailed view of the cross-section of the outer foot 21 along the line B-B of FIG. 2B. The two snap hooks 8 of the outer male foot part 5 of the skid 3 are disclosed, the snap hooks 8 being arranged with mirror symmetry in pairs and each having a snap arm 8', a hook head 9 with undercut 9' and a rear side 10. An intermediate space 24 is arranged between the rear sides 10 of the snap hooks 8. The undercuts 9' of the hook heads 9 face away from one another and the rear sides 10 of the snap arms 8 face each other. Each hook head 9 of the snap hooks 8 is engaged in a latch element 7, each hook head 9 engaging in a recess 23 of the latch element 7 and forming a snap connection 6 with the latch element 7, thus locking the female foot part 4 of the upper part 2 to the male foot part 5 of the skid 3. Also shown is a securing element 12 with symmetrically pointed free end 13. In the example shown, the securing element 12 with free end 13 has an arrow-shaped cross-section. The free end 13 is tapered towards the center. In addition, the last portion 11 of the rear side 10 of the snap hook 8 is beveled in the region of the hook head 9 leading to the tip. This bevel 11 causes that the tip of the hook head 9 is weakened at the end of the snap hook 8 and, when assembling the skids 3 to the upper part 2, slides continuously along the beveled side of the symmetrically pointed free end 13 of the securing element 12 into the engaged state. Also shown is an outer wall 14 of the outer female foot part 4, which encloses the outer male foot part 5 and its inner wall 15. In addition, the ribs 16 of the outer female foot part 4 and the ribs 17 of the outer male foot part 5 are visible. Because of the outer wall 14 and the inner wall 15, the foot 21 has a double wall, which has the effect of reinforcing the feet. Damage to the feet due to impacts from a forklift truck or because of falling down is thus largely avoided.

Figure 5A:
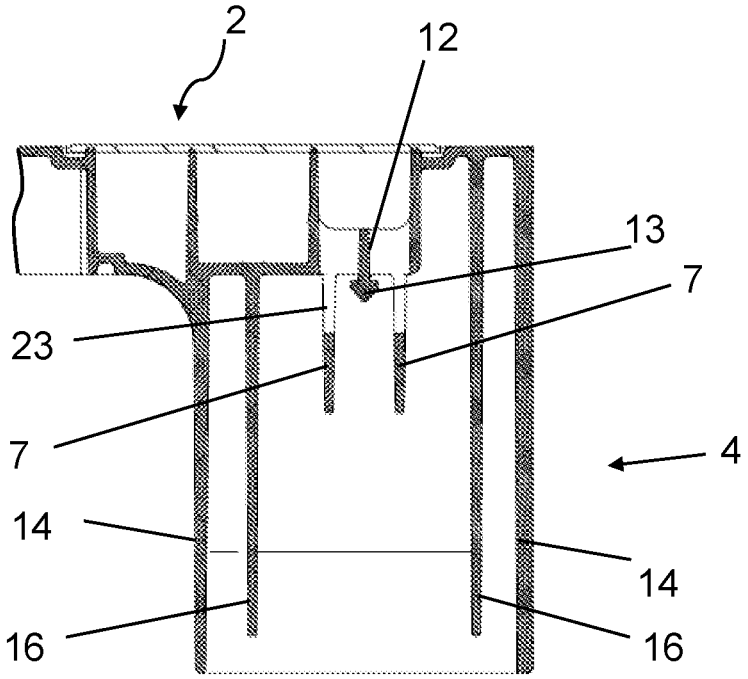
FIG. 5A shows a detailed view of the cross-section of the female foot part of FIG. 4B along the line C-C of FIG. 7.
Figure 7:
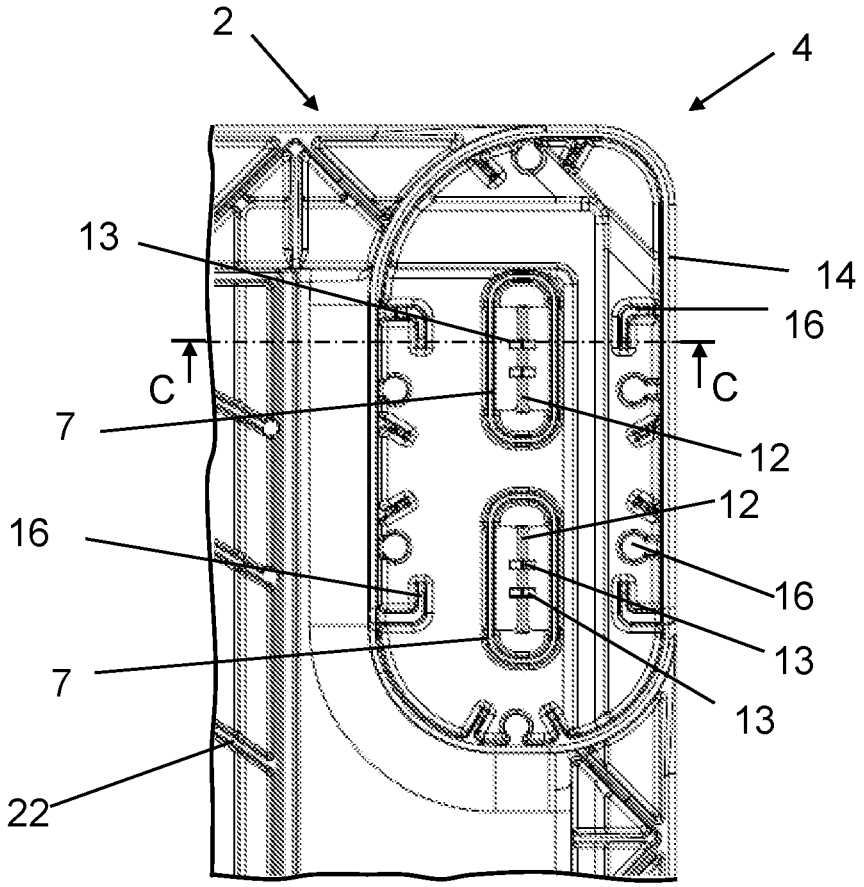
FIG. 7 shows a detailed perspective view from below of the lower side of a female foot part of the upper side of the pallet.

FIG. 5A shows a cross-section along the line C-C of FIG. 7 through an outer female foot part 4 of an upper part 2 in the unassembled state. The outer wall 14 extends over the entire height of the outer female foot part 4, preferably around substantially the entire foot. By entire height it is understood that the outer wall of the outer female foot part extends from the upper side of the pallet to the lower side of the skid which can be placed onto a support surface. The female foot part 4 comprises ribs 16 which are slidable into the ribs of the male foot part (shown in FIG. 5B) when the upper part 2 and skids (not shown) are assembled. Also visible are the two longitudinal sides of the latch element 7 with recesses 23 into which the snap hooks (shown in FIG. 5B) engage. The securing element 12 with a free end 13 tapering towards the center has an arrow-shaped cross-section. The free end 13 is symmetrically pointed.

Figure 5B:
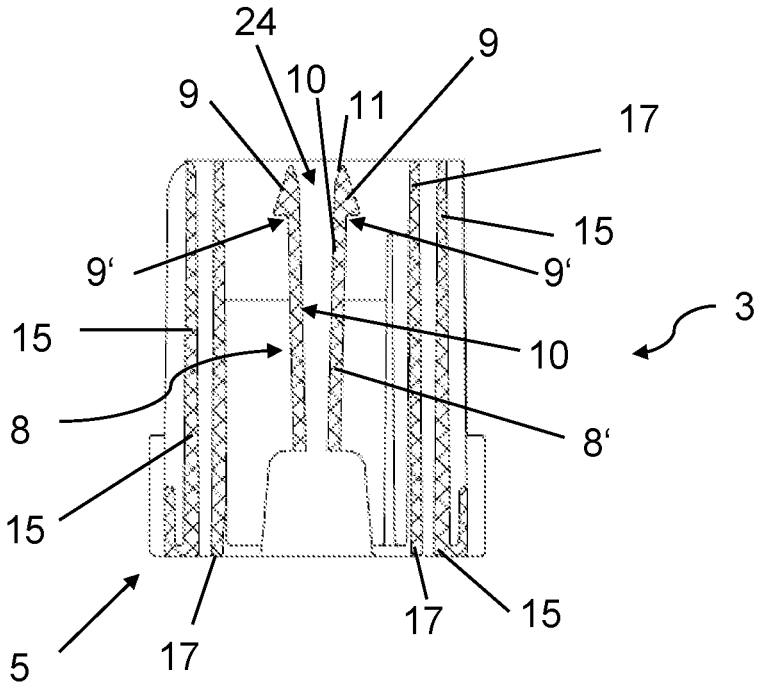
FIG. 5B shows a detailed view of the cross-section of the male foot part of FIG. 4B.

FIG. 5B shows a cross-section through an outer male foot part 5 of an outer skid 3 in the unassembled state. The male foot part 5 has inner walls 15 which can be pushed completely into the outer female foot part 4 (shown in FIG. 5A) when assembling the skids 3 to the upper part (shown in FIG. 5A). The ribs 17 of the male foot part 5 extend over the entire height of the male foot part 5. The male foot part 5 has two snap hooks 8, the snap hooks 8 being arranged with mirror symmetry in pairs and each having a snap arm 8', a hook head 9 with undercut 9' and a rear side 10. The undercuts 9' of the hook heads 9 face away from one another and the rear sides 10 of the snap hooks 8 face each other. An intermediate space 24 is arranged between the rear sides 10 of the snap hooks 8.

Figure 6:
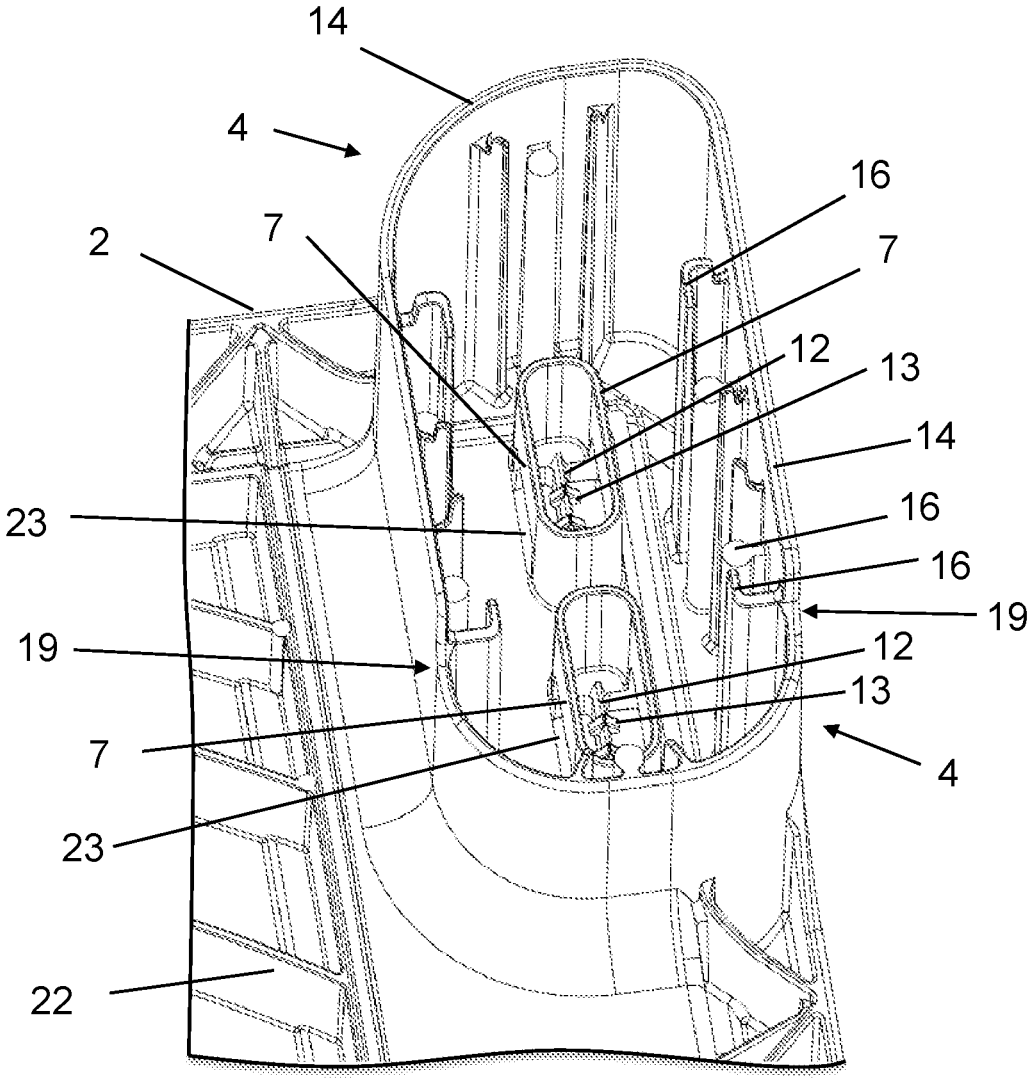
FIG. 6 shows a detailed view of the perspective illustration obliquely from below of the lower side of a female foot part of the upper side of the pallet.

FIG. 6 shows a detailed view of the perspective illustration from obliquely below of the lower side of an outer female foot part 4 of the upper part 2 of a plastic pallet in the unassembled state. The outer female foot part 4 has an outer wall 14 which extends over the entire height in the outer region of the foot part 4. The outer region of the foot part 4 is understood to be the entire region which encloses the foot part 4, with the exception of a recess 19 which serves to receive the connecting pieces of the skids in the assembled state. The outer female foot part 4 has a plurality of ribs 16 extending substantially over the entire height of the foot part. The ribs have different cross-sections, for example a T-shaped, angular or rectangular cross-section. The female foot part 4 has two latch elements 7, each with two recesses 23 for receiving snap hooks (shown in FIG. 4B). The latch elements 7 each have an elongated shape with the recesses 23 being arranged on the two longitudinal sides of the elongated latch elements 7. Each latch element 7 has one securing element 12 in the center of the elongated shape, each having two free ends 13 which serve to hold the snap hooks (not shown) in the engaged state when the pallet is assembled. In this preferred embodiment, two free ends 13 are used to hold the wide hook head (not shown) in the engaged position of an assembled pallet. The upper part 2 has cross struts 22 on the lower side for reinforcing the upper part 2 of the pallet.

FIG. 7 shows a detailed view from below of the lower side of an outer female foot part 4 of the upper part 2 of a plastic pallet with an outer wall 14, ribs 16, two latch elements 7 of elongated shape each with one securing element 12. Each of the two securing elements 12 has two free ends 13. Also visible are the cross struts 22 of the upper part 2.

Figure 8:
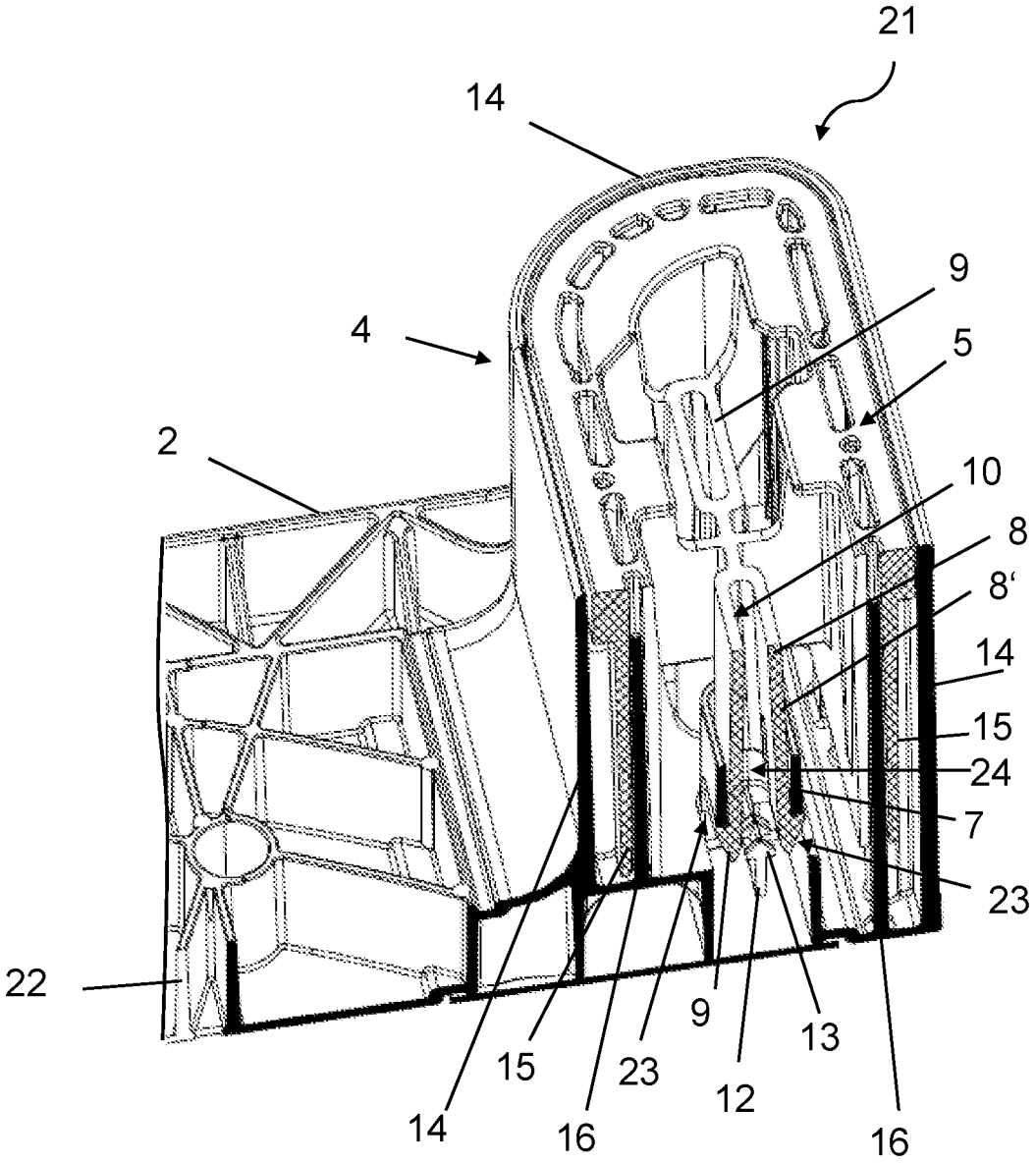
FIG. 8 shows a perspective illustration of the cross-section of the foot of FIG. 5A along the line B-B of FIG. 2B obliquely from below of the lower side of the pallet in the assembled state.

FIG. 8 shows a perspective view of the cross-section of a foot 21 of FIG. 5A along the line B-B of FIG. 2B from obliquely below of the lower side of the upper part 2 of the pallet in the assembled state. The foot 21 shows the outer female foot part 4 with outer wall 14, rib 16, the latch element 7 with two recesses 23 and the securing element 12 with free end 13, as well as the outer male foot part 5 with inner wall 15, snap hooks 8 arranged in pairs with snap arm 8', rear side 10 and hook head 9. An intermediate space 24 is arranged between the rear sides 10 of the snap hooks 8. Also visible are the cross struts 22 of the upper part 2.

FIGS. 1-8 show a possible embodiment of the invention, wherein this embodiment has three longitudinal skids and the outer feet are arranged along the short transverse side of the plastic pallet. Within the meaning of the invention, other embodiments with more than three skids in various arrangements are also conceivable. For example, a plastic pallet with five or six skids is possible, each skid having two outer male foot parts and a middle male foot part. For example, a pallet of this type is possible with five skids, of which three skids extend in one direction and only two skids extend in the transverse direction along the sides of the pallet. Or, a pallet with six skids is possible, with the skids being arranged as three transverse skids and three longitudinal skids so that the forklift truck can transport the pallet from both the longitudinal side and the transverse side. Also conceivable is a plastic pallet with three transverse skids, in which case the outer feet are arranged along the long longitudinal side. In addition, each foot can have any number of snap connections in various arrangements.

Also possible is an arrangement of a plurality of securing elements with one or more free ends between a pair of snap hooks to increase the security of the snap connection.

Although various embodiments of the present invention have been described and shown, the invention is not restricted thereto, but may also be embodied in other ways within the scope of the subject-matter defined in the following claims.

What is claimed is:

1. A plastic pallet with an upper part provided with outer and middle female foot parts and with skids provided with outer and middle male foot parts, wherein the male foot parts of the skids can be pushed into the female foot parts of the upper part, wherein in the assembled state of the plastic pallet, the male foot parts together with the female foot parts form feet, wherein the foot parts of the upper part and the foot parts of the skids can be fastened to one another by means of snap connections, wherein each male foot part comprises at least two snap hooks which are arranged with mirror symmetry in pairs and which each have a hook head with undercut, a snap arm and a rear side, wherein the undercuts of the hook heads face away from one another and the rear sides of the snap hooks face one another, wherein each female foot part comprises at least one latch element into which the hook heads are engaged in the assembled state thereby forming a snap connection in each case, and wherein an intermediate space is arranged between the rear sides of the snap hooks, wherein the female foot parts are integrally connected to the upper part, wherein each female foot part comprises at least one securing element having at least one free end in each case, wherein the securing element is integrally connected to the female foot part, and wherein the securing element protrudes the intermediate space between the rear sides of the snap hooks so that the snap hooks remain in the engaged position.

2. The plastic pallet according to claim 1, wherein the respective free end of the at least one securing element is tapered towards the center.

3. The plastic pallet according to claim 1, wherein the respective free end of the at least one securing element is symmetrically pointed.

4. The plastic pallet according to claim 1, wherein the respective free end of the at least one securing element has an arrow-shaped cross-section.

5. The plastic pallet according to claim 1, wherein the last portion of the rear side of the snap hook leading to the tip is beveled or rounded.

6. The plastic pallet according to claim 1, wherein the female foot parts of the upper part have an outer wall with ribs and the male foot parts of the skids have an inner wall with ribs.

7. The plastic pallet according to claim 6, wherein the outer wall of the female foot parts encloses the male foot parts in each case and extends over the entire height of the outer male foot parts so that in the assembled state of the plastic pallet, the outer male foot parts of the skids are completely pushed into the outer female foot parts of the upper part.

8. The plastic pallet according to claim 6, wherein the ribs serve as spacers between the inner wall and the outer wall.

9. The plastic pallet according to claim 1, wherein the male foot parts of a single skid can be pushed separately from the male foot parts of the other skids into the female foot parts of the upper part.

10. The plastic pallet according to claim 1, wherein the plastic pallet has three skids.

11. The plastic pallet according to claim 2, wherein the respective free end of the at least one securing element is symmetrically pointed.

12. The plastic pallet according to claim 7, wherein the ribs serve as spacers between the inner wall and the outer wall.

13. The plastic pallet according to claim 2, wherein the respective free end of the at least one securing element has an arrow-shaped cross-section.

14. The plastic pallet according to claim 3, wherein the respective free end of the at least one securing element has an arrow-shaped cross-section.

15. The plastic pallet according to claim 2, wherein the last portion of the rear side of the snap hook leading to the tip is beveled or rounded.

16. The plastic pallet according to claim 3, wherein the last portion of the rear side of the snap hook leading to the tip is beveled or rounded.

17. The plastic pallet according to claim 4, wherein the last portion of the rear side of the snap hook leading to the tip is beveled or rounded.

18. The plastic pallet according to claim 2, wherein the female foot parts of the upper part have an outer wall with ribs and the male foot parts of the skids have an inner wall with ribs.

19. The plastic pallet according to claim 3, wherein the female foot parts of the upper part have an outer wall with ribs and the male foot parts of the skids have an inner wall with ribs.

20. The plastic pallet according to claim 4, wherein the female foot parts of the upper part have an outer wall with ribs and the male foot parts of the skids have an inner wall with ribs.

* * * * *